United States Patent [19]

Bolin

[11] Patent Number: 4,700,396

[45] Date of Patent: Oct. 13, 1987

[54] SOUND-WAVE RECEIVING APPLIANCE

[76] Inventor: Gustav G. A. Bolin, Renstiernas gata 12, S-116 31, Stockholm, Sweden

[21] Appl. No.: 629,845

[22] Filed: Jul. 11, 1984

[51] Int. Cl.[4] ..... H04R 1/02

[52] U.S. Cl. ..... 381/91; 381/120; 381/152; 381/188; 381/190; 381/205

[58] Field of Search ..... 381/91, 88, 120, 152, 381/153, 158, 188, 190, 205; 179/110 A, 121 R, 121 D, 146 R, 147, 178, 181 R, 181 W

[56] References Cited

U.S. PATENT DOCUMENTS

| | | | |
|---|---|---|---|
| 1,560,502 | 11/1925 | Forest | 381/152 |
| 2,350,010 | 5/1944 | Beckley | 381/91 |
| 2,565,159 | 8/1951 | Williams | 381/190 |
| 3,058,015 | 10/1962 | Nesh | 310/334 |
| 3,167,668 | 1/1965 | Nesh | 310/340 |
| 3,908,503 | 9/1975 | Bolin | 84/1.14 |
| 4,104,945 | 8/1978 | Bolin | 84/1.15 |
| 4,204,096 | 5/1980 | Barcus et al. | 381/158 |
| 4,593,404 | 6/1986 | Bolin | 381/88 |

*Primary Examiner*—Gene Z. Rubinson
*Assistant Examiner*—Danita R. Byrd
*Attorney, Agent, or Firm*—Finnegan, Henderson, Farabow, Garrett & Dunner

[57] ABSTRACT

A sound-wave receiving applicance comprises a resonance panel and a crystal type piezoelectric microphone responsive to oscillations generated by the soundwaves, said microphone being adapted for connection to an amplifier. The crystal of the microphone is subjected, between two pole members, to a mechanical initial pressure to increase the pressure sensitivity of the microphone relative to the resonance panel. The receiving applicance preferably has means for manual adjustment of the initial pressure which is absorbed by the resonance panel via one pole member. The resonance panel of the receiving appliance preferably is made of a material, such as a cellular plastic, having a higher porosity and a lower specific gravity than ordinary wood.

3 Claims, 4 Drawing Figures

SOUND-WAVE RECEIVING APPLIANCE

BACKGROUND OF THE INVENTION

The present invention relates to a sound-wave receiving appliance comprising a resonance panel and a crystal type piezoelectric microphone responsive to oscillations of said resonance panel generated by the sound-waves, said microphone being adapted for connection to an amplifier.

The invention aims at providing a substantial increase of the receptivity of the receiving appliance to enable it to transform, with perfect volume and quality, sound-waves in the form of, for example, speech or music transmitted also from a long distance, such as several meters from the resonance panel.

SUMMARY OF THE INVENTION

It has been found that this extraordinary effect can be achieved by placing the crystal of the microphone between two pole members and subjecting it to a mechanical and manually adjustable initial pressure in order to vary the pressure sensitivity of the microphone relative to the resonance panel. The initial pressure is adjustable, for example for adaptation to local conditions, and is transmitted preferably from one pole member to the panel. Even though resonance panels made of ordinary wood give a certain improvement, the amplification will be especially pronounced when the panel is made of a lighter or more porous material, such as cellular plastic, soft fiberboard, balsa wood etc. By placing a few receiving appliances on, for example, the wall or the stage of a theater, the invention makes it possible to obtain a harmonic and uniform transmission of the sound effects (speech, music) from all points of the hall. The actors on the stage thus need not carry microphones near their mouths to make the amplified sound reach the audience.

BRIEF DESCRIPTION OF THE DRAWINGS

The invention will be described in more detail below, reference being made to accompanying drawing illustrating embodiments. In the drawings.

DETAILED DESCRIPTION OF THE INVENTION

Figure 1:
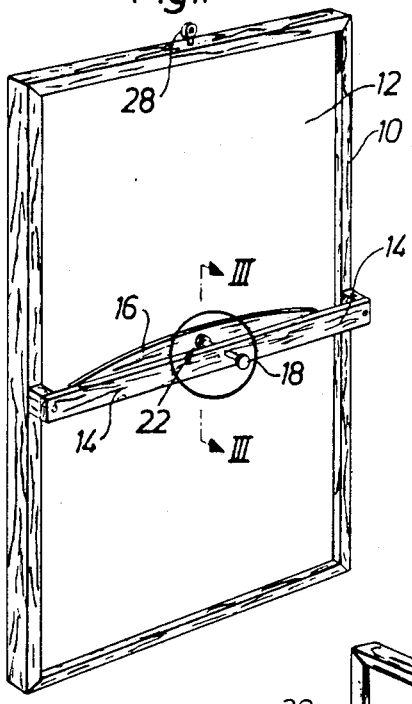
FIG. 1 is a perspective view of a receiving appliance.
Figure 2:
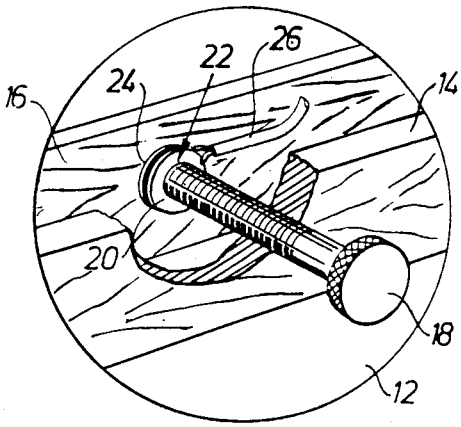
FIG. 2 shows the encircled portion of FIG. 1 on a larger scale.

In the drawing, 10 denotes a frame which is shown to be square, but which may also have a different shape. The frame surrounds a resonance panel 12 which, according to a particularly useful embodiment, consists of cellular plastic made from plastic granules which are blown and sintered together under the action of heat so that the plastic will have high porosity and low specific gravity. The thickness of the panel may amount to a few centimeters. Approximately in the center of the rectangular frame 10 a cross-bar 14 is secured to the long sides of the frame, and a lath 16 of, for example, wood is secured to the panel 12 directly behind the cross-bar 14. A screw 18 is threaded into the cross-bar 14 to engage one pole member 20 of a piezoelectric microphone generally designated 22. The other pole 24 of the microphone is supported by the lath 16. Between the two pole members, the crystal 25 of the microphone is disposed in per se known manner. Both poles are connected, each via one conductor in a flex 26, to an amplifier of known type (not shown). According to the invention, the crystal of the microphone 22 is subjected to a controllable initial pressure by means of the screw 18 between the two pole members 20, 24. The said pressure may amount to, for example, several hectogrammes or more.

It has been found that the receiving appliance, because of the initial pressure applied, can react in an essentially improved manner to sound-waves incident on the panel, such that the sound-source can be placed at a distance of many meters from said resonance panel, and the electric impulses emanating from the crystal will nevertheless have sufficient intensity to make the amplifier reproduce the incident sound-waves in a fully audible and enjoyable manner.

Figure 4:
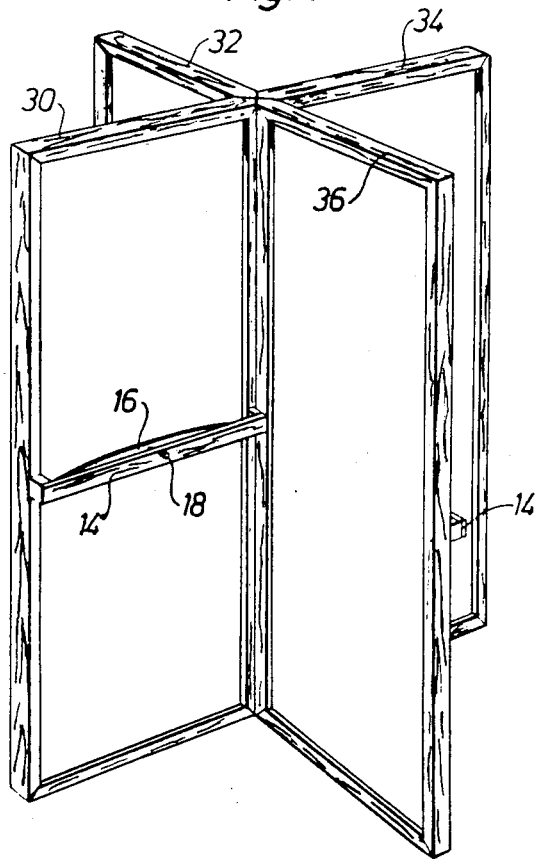
FIG. 4 is a perspective view of a further embodiment of the invention.
Figure 3:
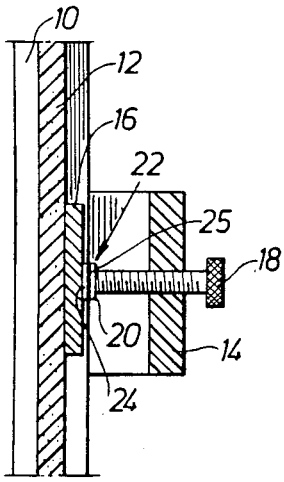
FIG. 3 is a section along line III—III in FIG. 1 on a still larger scale.

The receiving appliance may be hung on the wall, for example by means of eye-bolts 28 (FIG. 1), but several receiving appliances may also be arranged in groups placed at an angle to one another so that, under favourable conditions, incoming sound-waves from all directions may impinge thereon. In the embodiment according to FIG. 4, four receiving appliances 30, 32, 34, 36 thus have been placed at 90° relative to one another, with a coincident longitudinal edge. The microphones 22 preferably are facing in the same direction in all receiving appliances and may be connected to the same or different amplifiers.

A suitable maximum side length of the resonance panels 12 is, for example, 40–100 centimeters.

What I claim and desire to secure by Letters Patent is:

1. A sound-wave receiving apparatus comprising a resonance panel, a crystal type piezoelectric microphone having a crystal and two pole members on either side of the crystal, said microphone being mounted on the panel so that its crystal is responsive to oscillations of said resonance panel generated by sound-waves and said microphone being adapted for connection to an amplifier, and a manually adjustable pressure means for subjecting the crystal between the two pole members to a mechanical pressure to vary the pressure sensitivity of said crystal relative to said resonance panel.

2. The sound-wave receiving apparatus of claim 1, wherein the resonance panel is of cellular plastic.

3. The sound-wave receiving apparatus of claim 1, wherein one pole member of the microphone is located next to a part of the resonance panel and said pressure means comprises an adjustable screw which presses the other pole member against said crystal to thereby vary the pressure on the crystal.

* * * * *